United States Patent [19]

Yoshioka et al.

[11] 3,946,184

[45] Mar. 23, 1976

[54] CIRCUIT BREAKER

[75] Inventors: Yoshio Yoshioka; Masanori Tsukushi, both of Hitachi, Japan

[73] Assignee: Hitachi, Ltd., Japan

[22] Filed: Nov. 4, 1974

[21] Appl. No.: 520,906

[30] Foreign Application Priority Data

Nov. 5, 1973 Japan ..... 48-123449

[52] U.S. Cl. ..... 200/148 D; 200/145; 200/148 F

[51] Int. Cl.[2] ..... H01H 33/88

[58] Field of Search..... 200/148 D, 148 B, 148 F, 200/148 R, 145

[56] References Cited

UNITED STATES PATENTS

| | | | |
|---|---|---|---|
| 2,454,586 | 11/1948 | Amer | 200/148 D |
| 3,532,843 | 10/1970 | Pucher | 200/148 D |
| 3,786,216 | 1/1974 | Beier et al. | 200/148 D |

*Primary Examiner*—Robert S. Macon
*Attorney, Agent, or Firm*—Craig & Antonelli

[57] ABSTRACT

A circuit breaker having a pair of circuit breaking units electrically insulated from ground by supporting means of electrical insulator, an actuator disposed on ground, and an actuating force transmission path including a single actuating rod of electrical insulator for connecting the actuator to the movable contacts in the circuit breaking units. In the circuit breaker, an electromagnetic actuating unit is disposed between the supporting means of electrical insulator and the circuit breaking units in electrically insulated relation from the circuit breaking units. This electromagnetic actuating unit comprises a current conducting path portion for electrically connecting the circuit breaking units in series with each other, means disposed in parallel with this current conducting path portion for producing an electromagnetic repulsive force, and means for transferring current flow to the repulsive force producing means from the current conducting path portion in response to the operation of the actuator so that the electromagnetic repulsive force produced by the repulsive force producing means can be used as an actuating force for driving the movable contacts in the circuit breaking units in the circuit breaking direction.

3 Claims, 8 Drawing Figures

CIRCUIT BREAKER

BACKGROUND OF THE INVENTION

1. Field Of The Invention

This invention relates to circuit breakers and more particularly to a circuit breaker of large capacity in which a pair of circuit breaking units are connected in series with each other.

2. Description Of The Prior Art

The voltage rating and current capacity of circuit breakers are progressively increasing with the increase in the electric power demand in recent years. Especially, in order to deal with the increase in the voltage rating, a pair of circuit breaking units of the same structure are connected in series with each other to restrict the voltage applied to a single circuit breaking unit.

In a circuit breaker having such a pair of circuit breaking units, the moving part of one of these circuit breaking units is disposed opposite to that of the other circuit breaking unit, and an actuating force transmission path for operatively connecting an actuator on ground to the moving parts of the circuit breaking units is disposed to extend between these circuits breaking units. Therefore, the construction of the actuating force transmission path can be simplified and the number of parts thereof can be reduced since the actuating force transmission path can be constituted by parts which are common to both these circuit breaking units.

In some circuit breakers, a large actuating force is required for breaking associated circuits. An example of such circuit breakers is a puffer type circuit breaker in which an arc extinguishing gas is compressed as soon as the circuit breaking operation takes place so as to supply a puff of this compressed gas to the space between the parted contacts.

In a circuit breaker of this kind, an especically large actuating force is required frequently in the circuit breaking operation as when an excessively large current such as a short-circuit current is interrupted. In such a case, the pressure in the vicinity of the arc makes an unusual rise due to the strong energy of the arc. This unusually high pressure acts as a reaction force against the actuating unit carrying out the circuit breaking operation and acts also to obstruct puffing of fresh arc extinguishing gas toward the arc. In such a case, therefore, the actuating force must be large enough to overcome the reaction force.

The actuating unit for causing the circuit breaking operation of the circuit breaker must thus be required to produce an actuating force which overcomes such a reaction force. However, the service life of various mechanical parts thereof would be reduced due to the fact that this actuating unit produces a large actuating force even when the reaction force is small, that is, when the current to be interrupted is small.

An improved circuit breaker which obviates such a defect is known. In this improved circuit breaker, an electromagnetic actuating unit is combined with the existing actuating unit. An actuating force proportional to a current to be interrupted can be obtained when the current flowing through the circuit breaker is utilized as a source for energizing the electromagnetic actuating unit. Further, the existing actuating unit in this improved circuit breaker is such that it ensures reliable interruption of a current for which the actuating force produced by the electromagnetic actuating unit cannot be solely relied upon.

However, according to the common practice, the electromagnetic actuating unit is provided for each of the circuit breaking units, or the electromagnetic force produced by such unit is utilized for operating the existing actuating unit. Thus, in the former case, the electromagnetic actuating unit is required in a number equal to the number of the circuit breaking units, while in the latter case, an arrangement for maintaining electrical insulation between the electromagnetic actuating unit and ground is additionally required due to the fact that the existing actuating unit is situated on ground.

SUMMARY OF THE INVENTION

It is an object of the present invention to provide a novel and improved circuit breaker which includes means for producing an actuating force proportional to a current to be interrupted and which is small in overall size by virtue of a unique construction.

Another object of the present invention is to provide a circuit breaker which eliminates impartation of an unnecessary force to an actuating rod of electrical insulator which constitutes a part of an actuating force transmission path between the moving parts of a pair of circuit breaking units and an actuator situated on ground while maintaining electrical insulation therebetween.

DESCRIPTION OF THE PREFERRED EMBODIMENTS

Figure 1:
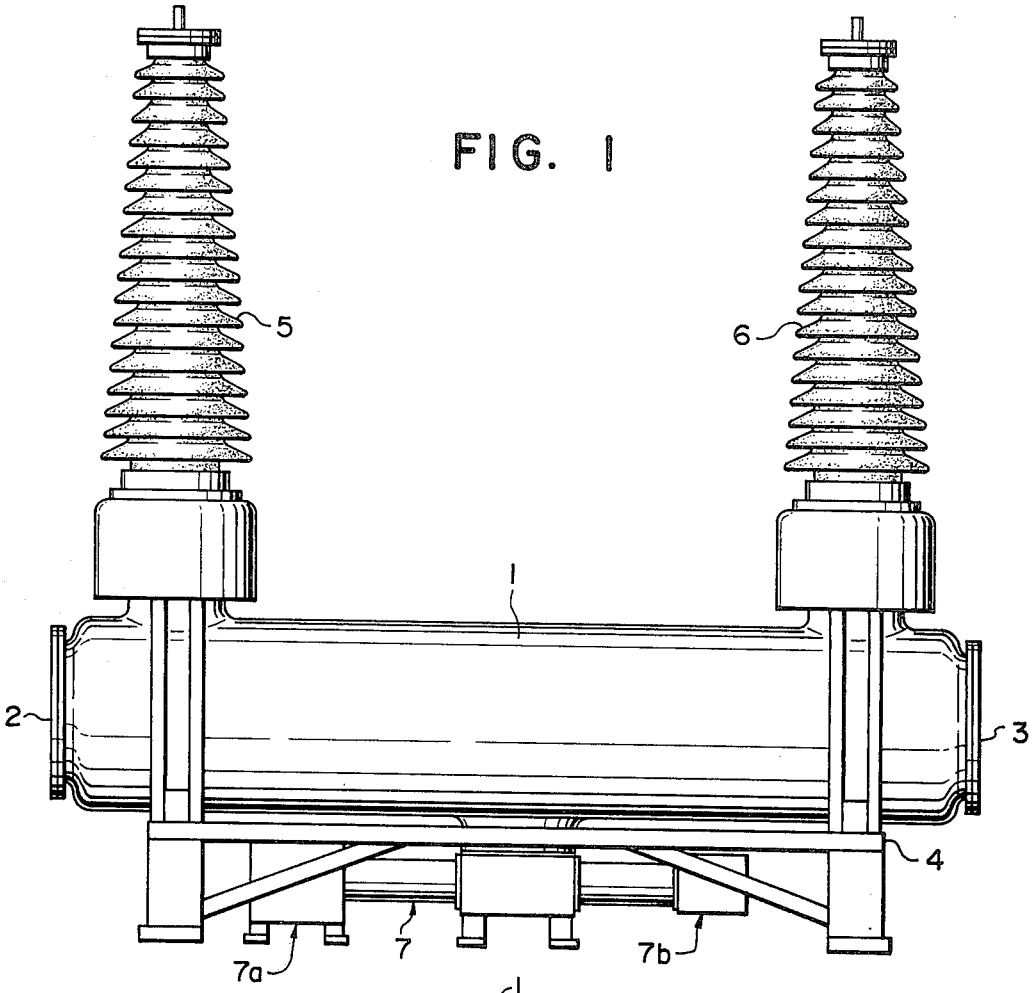
FIG. 1 is a front elevational view of an embodiment of the circuit breaker according to the present invention.

FIG. 1 shows a circuit breaker of the so-called grounded tank type. Referring to FIG. 1, a grounded tank 1 at ground potential is provided with a pair of axially opposite end openings which are tightly closed by respective end covers 2 and 3. An arc extinguishing gas, for example, $SF_6$ is charged in this tank 1. A part of circuit breaking units (not shown) are housed within this tank 1 in an electrically insulated relationship from the tank 1. A base 4 is secured to the foundation to fixedly support various elements including the tank 1 thereon. A pair of bushings 5 and 6 are erected on opposite end portions respectively of the tank 1. In actuator 7 is disposed on ground beneath the tank 1 for actuating the circuit breaking units which make and break the circuit within the tank 1. This actuator 7 comprises an actuating unit 7*a* for actuating the circuit breaking units in the circuit breaking direction and a making unit 7*b* for restoring the circuit breaking units to the circuit making position.

Figure 2:
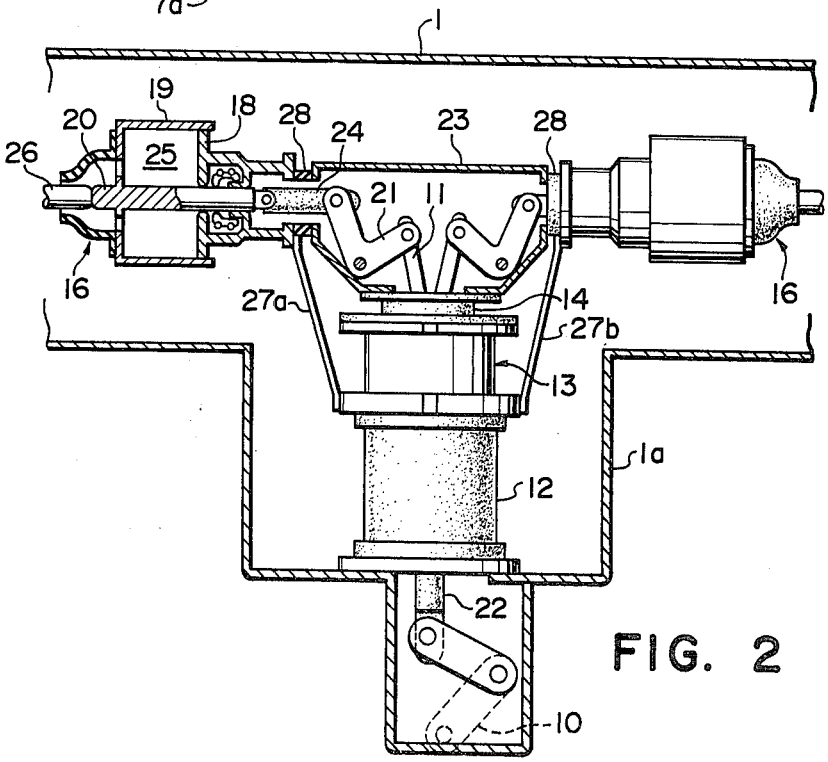
FIG. 2 is a partial view of the circuit breaker of FIG. 1 with parts shown in section.

FIG. 2 is a partial view of the circuit breaker of FIG. 1 with parts shown in section. Referring to FIG. 2, a central cylindrical portion 1*a* extends downward from the bottom of the grounded tank 1. A cylindrical supporting member 12 of electrical insulator is erected on the inner bottom surface of the cylindrical extension 1*a* of the tank 1, and an electromagnetic actuating unit 13, an annular member 14 of electrical insulator and a bracket 23 are stacked up in the above order on the cylindrical supporting member 12. A pair of pistons 18 are fixed to the opposite arms of the bracket 23 through electrical insulating members 28 respectively, and the moving parts 16 of the circuit breaking units are arranged to make sliding movement by being guided by the respective pistons 18. The moving part 16 of each circuit breaking unit is composed of a puffer cylinder 19 arranged for sliding movement relative to the piston 18 and a movable contact 20 fixed to the puffer cylinder 19. The puffer cylinder 19 and piston 18 in each circuit breaking unit define a puffer chamber 25 therebetween so that an arc extinguishing gas contained within this puffer chamber 25 can be compressed in response to the parting movement of the movable contact 20 in the moving part 16 of the circuit breaking unit away from a stationary contact 26. This compressed gas acts to puff out the arc generated across the movable and stationary contacts 20 and 26. The stationary contacts 26 in the circuit breaking units are connected to the respective central conductors in the bushings 5 and 6 shown in FIG. 1. Further, these circuit breaking units are electrically connected in series with each other by a pair of connecting conductors 27*a* and 27*b* connected to the electromagnetic actuating unit 13.

These two circuit breaking units are arranged in such a manner that the moving parts 16 thereof are disposed opposite to each other. A pair of rods 24 of electrical insulator are connected at one end thereof to the confronting ends of the moving parts 16 of the circuit breaking units respectively and at the other end thereof to one end of a pair of L-shaped levers 21 respectively. These L-shaped levers 21 are swingably supported within the bracket 23. A pair of connecting rods 11 are connected at one end thereof to the respective L-shaped levers 21 and at the other end thereof to the upper end of a single actuating rod 22 of electrical insulator. The lower end of this actuating rod 22 is connected to an L-shaped lever 10 which is operatively connected to the actuator 7 for making arcuate movement.

As will be apparent from the above description, only one actuating rod 22 of electrical insulator is provided in the path for transmitting the actuating force from the actuator 7 to the pair of the movable contacts 20. Thus, the actuating force produced by the actuating unit 7*a* in the actuator 7 is transmitted to the moving parts 16 of the two circuit breaking units through the single actuating rod 22.

As described with reference to FIG. 2, the electromagnetic actuating unit 13 is disposed beneath the bracket 23. By virtue of the disposition of the electromagnetic actuating unit 13 in such a location, the circuit breaker according to the present invention is relatively compact in construction and small in overall size due to the fact that the electromagnetic actuating unit 13 can be accommodated within the cylindrical extension 1*a* of relatively short axial length extending from the tank 1. Further, the structure of the remaining portions may be substantially the same as that of the prior art structure, and this prior art structure may be utilized without any substantial alteration. The internal structure of the grounded tank 1 may remain the same as the prior art structure when an electromagnetic actuating unit of this kind may be incorporated in the actuator 7 located on ground. However, a complex structure is required for electrical insulation from ground when the current flowing through the circuit breaking units is utilized as a source for energizing the electromagnetic actuating unit. In the form shown in FIG. 2, the electromagnetic actuating unit 13 is electrically insulated from ground by the cylindrical supporting member 12 of electrical insulator. This single cylindrical supporting member 12 is effectively utilized for ensuring electrical insulation between the circuit breaking units and ground.

The circuit breaking operation of the circuit breaking units shown in the circuit making state in FIG. 2 will be briefly described while especially referring to the left-hand one since the right-hand one is symmetrical with the left-hand one. In breaking the circuit, the actuating rod 22 is urged downward by the actuating force produced by the actuating unit 7*a* in the actuator 7. The downward movement of the actuating rod 22 actuates the electromagnetic actuating unit 13 the structure of which is described in detail later. An electromagnetic repulsive force is produced in the electromagnetic actuating unit 13 and the L-shaped lever 21 is caused to swing clockwise to urge the puffer cylin cylinder 19 and movable contact 20 rightward in FIG. 2. The arc generated due to the parting movement of the movable and stationary contacts 20 and 26 is extinguished by the puff of the arc extinguishing gas compressed in the puffer chamber 25. This electromagnetic repulsive force is produced in the electromagnetic actuating unit 13 by the current to be interrupted by the circuit breaking unit, and the pressure rise in the puffer chamber 25 is a function of the current to be interrupted so that a stable circuit breaking performance can be exhibited.

Figure 3:
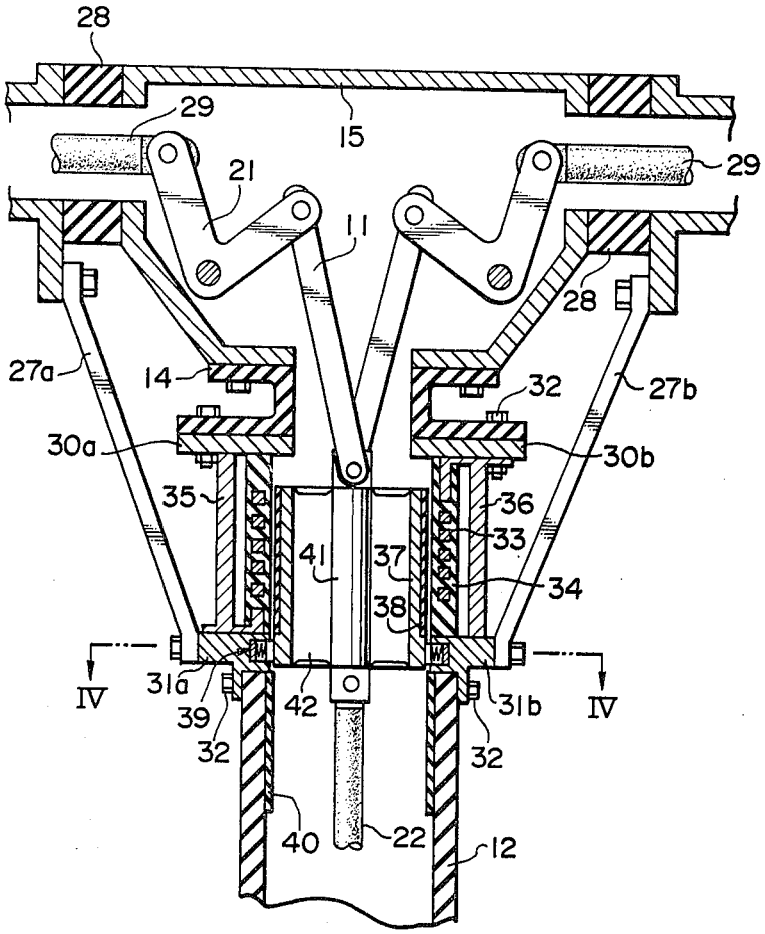
FIG. 3 is an enlarged sectional view of parts of FIG. 2.
Figure 4:
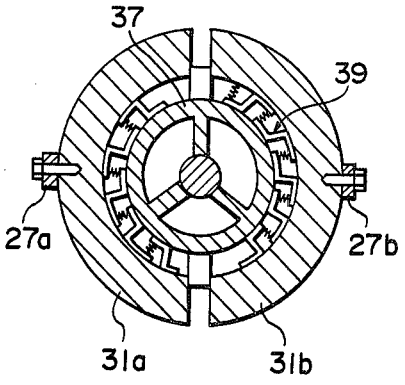
FIG. 4 is a sectional view taken on the line IV—IV in FIG. 3.

Referring now to FIGS. 3 and 4, the structure of the electromagnetic actuating unit 13 will be described in detail. FIG. 3 is an enlarged sectional view of parts of FIG. 2 to show the arrangement of elements constituting the electromagnetic actuating unit 13 as well as those disposed in the vicinity of the electromagnetic actuating unit 13.

A pair of conductors 30*a*, 30*b* and another pair of conductors 31*a*, 31*b* are fixed to the lower surface of the annular insulating member 14 and to the upper surface of the cylindrical supporting member 12 respectively by bolts 32. Each of these conductors 30*a*, 30*b*, 31*a* and 31*b* is in the form of a semiannular member obtained by splitting an annulus into halves in the direction of the diameter. A coil 33 is disposed between the spaced pairs of these semiannular conductors 30*a*, 30*b* and 31*a*, 31*b*. This coil 33 is molded within a cylindrical member 34 of electrical insulator. The semiannular conductors 31*a* and 31*b* are electrically connected to the circuit breaking units by the connecting conductors 27*a* and 27*b* respectively. The coil 33 is electrically connected at the opposite ends thereof to respective supporting fixtures 35 and 36. On the other hand, a rod 41 and a cylinder 37 both of conductive metal are mechanically secured by a rib 42 to an upper portion or a portion of the actuating rod 22 opposite to the coil 33. This conductive cylinder 37 is covered with an electrical insulator layer 38 except the portion opposite to the semiannular conductors 31*a* and 31*b*. The semiannular conductors 31*a* and 31*b* are electrically connected to the conductive cylinder 37 by a plurality of Z-shaped current collecting elements 39. The inner wall surface of the cylindrical supporting member 12 is also partly covered with an electrical insulator layer 40.

FIG. 4 is a sectional view taken on the line IV—IV in FIG. 3. As shown in FIG. 4, the connecting conductors 27*a* and 27*b* connecting the semiannular conductors 31*a* and 31*b* to the circuit breaking units respectively are electrically isolated from each other by the gap defined between the semiannular conductors 31*a* and 31*b*. These connecting conductors 27*a* and 27*b* are electrically connected to each other by the current collecting elements 39 and conductive cylinder 37. The semiannular conductors 30*a* and 30*b* are also electrically isolated from each other by the gap defined therebetween.

It will thus be seen that the circuit breaking units are mechanically connected to the electromagnetic actuating unit 13 by means including the electrical insulating members 14 and 28 and are electrically connected to the electromagnetic actuating unit 13 by the connecting conductors 27*a* and 27*b* only. In the circuit making state shown in FIG. 3, therefore, current flows through the path which is traced from the left-hand circuit breaking unit — connecting conductor 27*a* — semiannular conductor 31*a* — current collecting elements 39 — cylinder 37 — current collecting elements 39 — semiannular conductor 31*b* — connecting conductor 27*b* to the right-hand circuit breaking unit. Although the current path consisting of the coil 33 and supporting fixtures 35, 36 exists between the semiannular conductors 31*a* and 31*b* in this electromagnetic actuating unit 13, the greater portion of current flows through the current path above described due to the impedance of the coil 33.

The circuit breaking operation is carried out by urging the actuating rod 22 downward by the actuating force produced by the actuating unit 7*a* in the actuator 7. The downward movement of the actuating rod 22 causes corresponding movement of the cylinder 37 away from the current collecting elements 39. The arc produced due to the movement of the cylinder 37 away from the current collecting elements 39 is extinguished by the narrow gap defined between the electrical insulating layers 38 and 40. Therefore, the current to be interrupted flows now through the coil 33 between the semiannular conductors 31*a* and 31*b*. In other words, the current flow is transferred to the coil 33 in the early stage of circuit breaking operation by the current transfer means such as the narrow-gap arc extinguishing means consisting of the electrical insulating layers 38 and 40. The operation of this current transfer means is caused by the actuating force of the actuating unit 7*a* in the actuator 7.

Upon completion of the current transfer to the coil 33, current is induced in the cylinder 37 by the magnetic flux generated by the coil 33 and flows through the cylinder 37 so that an electromagnetic repulsive force, which is proportional to the second power of the current to be interrupted, is produced between the coil 33 and the cylinder 37. The cylinder 37 is urged downward by this electromagnetic repulsive force to cause clockwise and counter-clockwise swinging movement of the respective L-shaped levers 21 thereby compressing the arc extinguishing gas in the puffer chambers 25. This compressed arc extinguishing gas is directed to the arc generated due to the parting movement of the conducts 20 and 26 to extinguish the arc, and at the same time, the circuit breaker is placed in the circuit breaking position.

The power of the arc increases with the increase in the current to be interrupted, and the internal pressure of the puffer chambers 25 may rise an unusually high level. This unusual rise in the pressure is considered to be attributable to a blocking phenomenon which occurs in the flowing path of the arc extinguishing gas which exerts the arc extinguishing action on the arc. This pressure rise appears as a reaction force against the circuit breaking operation. However, in the electromagnetic actuating unit 13 in the present invention, an actuating force which overcomes such reaction force is produced due to the fact that the electromagnetic repulsive force generated thereby is proportional to the second power of the current to be interrupted. Therefore, in interrupting a large current by the circuit breaking units, the parting speed of the movable contacts 20 is sufficiently high and the pressure of the arc extinguishing gas directed to the arc is also sufficiently high. On the other hand, the actuating unit 7*a* in the actuator 7 may be such that it provides a sufficient parting speed of the movable contacts away from the stationary contacts when the current to be interrupted, hence the reaction force is relatively small.

Further, the strong electromagnetic force produced by the electromagnetic actuating unit 13 does not act as a tensile force for the actuating rod 22. In other words, the actuating rod 22 is subject only to the actuating force produced by the actuating unit 7*a* in the actuator 7. The cylinder 37 is fixed to the rod 41 connected to the actuating rod 22. Therefore, any excessive force is not imparted to the actuating rod 22. The compressive force imparted to the actuating rod 22 by the electromagnetic actuating unit 13 can be absorbed by providing, for example, a movable connection having a play due to an elongate hole at a lower part of the actuating rod 22.

Figure 5:
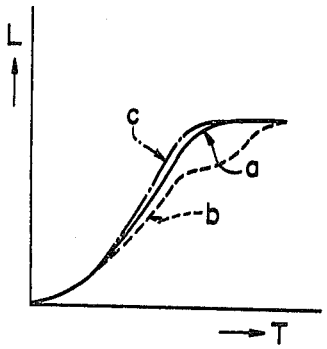
FIG. 5 is a graph showing the contact parting distance relative to time.
Figure 6:
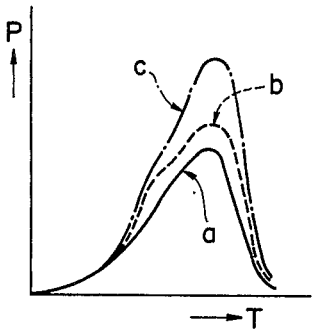
FIG. 6 is a graph showing the internal pressure of a puffer chamber relative to time.

The stroke of the movable contact relative to the stationary contact and the pressure built up within the puffer chamber will be described with reference to two cases in which a no-load current and a large current are interrupted by a circuit breaker which is not provided with the electromagnetic actuating unit 13. The stroke varies relative to time as shown in FIG. 5 in which the vertical and horizontal axes represent the contact parting distance L and time T respectively. In FIG. 5, the curve *a* represents the case in which a no-load current is interrupted, while the curve *b* represents the case in which a larage current is interrupted. The pressure built up within the puffer chamber varies relative to time as shown in FIG. 6 in which the vertical and horizontal axes represent the pressure P and time T respectively. In FIG. 6, the curve *a* represents the case in which a no-load current is interrupted, while the curve *b* represents the case in which a large current is interrupted. It will be apparent from FIG. 6 that the pressure within the puffer chamber varies in a manner as shown by the curve *b* in the case of interruption of a large current, and a reaction force due to this pressure is imparted to the actuating unit. Thus, the stroke varies in a manner as shown by the curve *b* in FIG. 5, and the contact parting speed is reduced.

However, when a large current is interrupted by the circuit breaker of the present invention which is provided with the electromagnetic actuating unit 13, a strong actuating force can be obtained and no reduction occurs in the contact parting speed as shown by the curve *c* in FIG. 5. Further, the pressure built up within the puffer chamber can be improved as shown by the curve *c* in FIG. 6.

Figure 7:
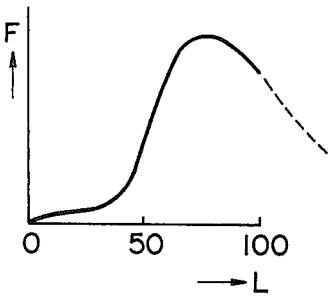
FIG. 7 is a graph showing the relation between the contact parting distance and the electromagnetic repulsive force.

FIG. 7 illustrates the relation between the electromagnetic repulsive force F shown on the vertical axis and the contact parting distance L shown on the horizontal axis. It will be seen from FIG. 7 that, according to the present invention, a large electromagnetic repulsive force is produced after the movable contact moves away from the stationary contact by about 50% of the full parting distance so as to prevent this electromagnetic repulsive force from providing a reaction force against the actuating force applied for breaking the circuit. Such an improved characteristic can be easily obtained by suitably selecting the shape of the cylinder 37 and the manner of winding the coil 33.

In the embodiment above described, the coil 33 in the electromagnetic actuating unit 13 is arranged to be stationary relative to the cylinder 37. However, the coil 33 may be movable and the cylinder 37 may be stationary. Further, the cylinder 37 may be replaced by an electromagnetic repulsive element in coil form.

Figure 8:
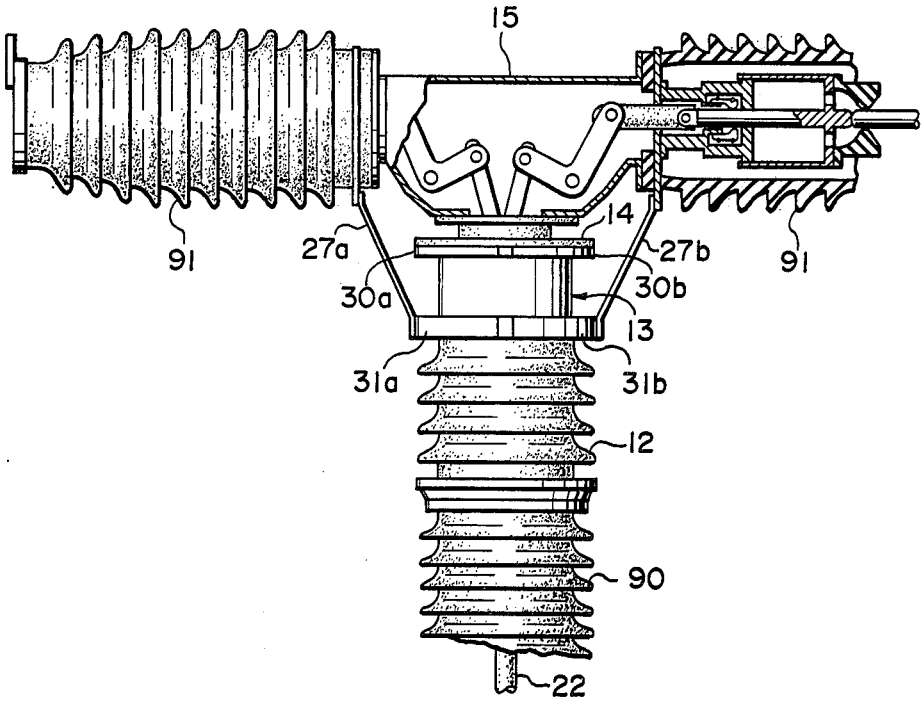
FIG. 8 is a partly sectional front elevational view of parts of another embodiment of the circuit breaker according to the present invention.

FIG. 8 shows another embodiment of the present invention in which an arc extinguishing gas is filled within a pair of insulating tubes, and a pair of circuit breaking units are disposed within the respective insulating tubes. In FIG. 8, like reference numerals are used to denote like parts appearing in FIG. 2.

Referring to FIG. 8, an insulating tube 90 is erected on ground to support thereon a stack consisting of a cylindrical supporting member 12 of electrical insulator, an electromagnetic actuating unit 13, an annular member 14 of electrical insulator, and a bracket 15 arranged in vertical series. An arc extinguishing gas is charged in each of a pair of insulating tubes 91, and a pair of circuit breaking units are housed within the respective insulating tubes 91.

The circuit breaking units are electrically breaking units are electrically connected in series with each other by connecting conductors 27*a*, 27*b* and electromagnetic actuating unit 13. In breaking the circuit, an actuating unit (not shown) located on ground urges an actuating rod 22 of electrical insulator downward as in the embodiment shown in FIG. 2. The effect of this second embodiment is similar to that of the first embodiment. In the second embodiment, the arc extinguishing gas filled within the insulating tubes 91 may leak through the space between semiannular conductors 30*a* and 30*b* and through the space between semiannular conductors 31*a* and 31*b*. This undesirable leakage of the arc extinguishing gas can be obviated by sealing the insulating tubes 91 against leakage. Alternatively, each pair of the semiannular conductors may be molded in a tubular mass of suitable material such as a resin so as to seal the space from which the arc extinguishing gas tends to leak.

We claim:

1. A circuit breaker comprising at least a pair of circuit breaking units (18, 19, 20, 25, 26) having their movable contacts (20) disposed opposite to each other, a bracket (23) connecting mechanically said circuit breaking units to each other, supporting means (12 or 90) of electrical insulator for mechanically supporting and fixing said bracket in position in electrically insulated relation from ground, an actuator (7) disposed on ground, an actuating force transmitting means (10, 11, 21, 22, 24) for connecting said actuator to the movable contacts in said circuit breaking units, an electromagnetic actuating unit for driving said circuit breaking units in the circuit breaking direction by being energized by a current flowing through said circuit breaking units to be interrupted thereby, a member (14) of electrical insulator for mechanically connecting said electromagnetic actuating unit to said bracket while electrically insulating said electromagnetic actuating unit from said bracket, and members (28) of electrical insulator for mechanically connecting said bracket to said circuit breaking units while electrically insulating said bracket from said circuit breaking units.

2. A circuit breaker as claimed in claim 1, wherein said electromagnetic actuating unit comprises a current conducting path portion (27*a*, 27*b*, 31*a*, 31*b*, 37, 39) arranged to connect said circuit breaking units in series with each other, means (33, 34, 35, 36, 38, 40) for producing an electromagnetic repulsive force in response to the transfer of current flow thereto from said current conducting path portion, and means (37, 41) for transmitting the electromagnetic repulsive force produced by said electromagnetic repulsive force producing means to the movable contacts in said circuit breaking units.

3. A circuit breaker as claimed in claim 1, wherein said actuating force transmitting means comprises at least one actuating rod (22) of electrical insulator, and said electromagnetic actuating unit (13) comprises a current conducting path portion (27*a*, 27*b*, 31*a*, 31*b*, 37, 39) arranged to connect said circuit breaking units in series with each other, means (33, 34, 35, 36, 38, 40) for producing an electromagnetic repulsive force in response to the transfer of current flow thereto from said current conducting path portion, a member (37) actuated by the electromagnetic repulsive force produced by said electromagnetic repulsive force producing means, and means (41, 42) for mechanically connecting said member to a portion of said actuating rod nearer to the movable contacts in said circuit breaking units.

* * * * *